US008601750B1

(12) United States Patent
Zhu

(10) Patent No.: US 8,601,750 B1
(45) Date of Patent: Dec. 10, 2013

(54) METHOD AND APPARATUS FOR GROUND INSTALLATION

(75) Inventor: Shou Qiang Zhu, Ontario (CA)

(73) Assignee: IP Power Holdings Limited, Hong Kong (CN)

( * ) Notice: Subject to any disclaimer, the term of this patent is extended or adjusted under 35 U.S.C. 154(b) by 0 days.

(21) Appl. No.: 13/488,168

(22) Filed: Jun. 4, 2012

(51) Int. Cl.
*E02D 5/74* (2006.01)

(52) U.S. Cl.
USPC ..... 52/155

(58) Field of Classification Search
USPC ..... 52/36.4, 155, 156, 159, 166
See application file for complete search history.

(56) References Cited

U.S. PATENT DOCUMENTS

| | | | | | |
|---|---|---|---|---|---|
| 608,753 | A * | 8/1898 | Carr | 52/166 |
| 1,041,233 | A * | 10/1912 | Blackburn | 52/159 |
| 1,666,765 | A * | 4/1928 | Ziebarth | 52/151 |
| 1,764,207 | A * | 6/1930 | Johnson | 52/151 |
| 2,084,239 | A * | 6/1937 | Bradford | 52/156 |
| 2,826,281 | A * | 3/1958 | Johnson | 52/158 |
| 2,887,195 | A * | 5/1959 | Jackson | 52/166 |
| 3,802,138 | A * | 4/1974 | McCarter | 52/148 |
| 3,918,509 | A * | 11/1975 | Trotter | 157/1.24 |
| 4,068,445 | A * | 1/1978 | Bobbitt | 52/741.11 |
| 4,778,142 | A * | 10/1988 | Roba | 248/545 |
| 4,945,675 | A * | 8/1990 | Kendrick | 47/33 |
| 5,377,447 | A * | 1/1995 | Fritch | 47/33 |
| 5,404,682 | A * | 4/1995 | West | 52/165 |
| 5,458,428 | A * | 10/1995 | West | 403/252 |
| D394,564 | S * | 5/1998 | Haney | D6/455 |
| 6,511,034 | B2 * | 1/2003 | Nicholson et al. | 248/523 |
| 6,802,630 | B2 * | 10/2004 | Doppelt | 362/414 |
| 6,953,257 | B2 * | 10/2005 | Pusch | 362/153.1 |
| 6,986,495 | B2 * | 1/2006 | Pinkleton et al. | 248/507 |
| 7,073,919 | B1 * | 7/2006 | Masina | 362/153.1 |
| 7,434,348 | B1 * | 10/2008 | Welch | 43/17 |
| 7,497,053 | B2 * | 3/2009 | Nicolet | 52/161 |
| 7,938,565 | B2 * | 5/2011 | Richard | 362/431 |
| D663,862 | S * | 7/2012 | Leadford | D25/126 |
| D666,474 | S * | 9/2012 | Despotellis | D8/354 |
| 2003/0014925 | A1 * | 1/2003 | Cox | 52/23 |
| 2005/0188627 | A1 * | 9/2005 | Alberts | 52/166 |
| 2006/0274537 | A1 * | 12/2006 | Randazzo | 362/413 |
| 2008/0010892 | A1 * | 1/2008 | Goebel | 43/2 |
| 2009/0090895 | A1 * | 4/2009 | Hogan, Jr. | 254/266 |
| 2012/0096778 | A1 * | 4/2012 | Bauletti | 52/155 |
| 2012/0234510 | A1 * | 9/2012 | Hill et al. | 160/405 |

FOREIGN PATENT DOCUMENTS

FR 2639392 A * 5/1990

* cited by examiner

*Primary Examiner* — Mark Wendell
*Assistant Examiner* — Keith Minter
(74) *Attorney, Agent, or Firm* — Che-Yang Chen; Law Office of Michael Chen

(57) ABSTRACT

A method and system for ground installation is disclosed. In one aspect, a method to secure a fixture on a ground includes steps of securing one or more anchors on a base plate; placing the base plate on the ground; applying force to one or more ground stakes into the ground through the base plate to secure the base plate on the ground; disposing the fixture on the base plate; and securing the fixture on the base plate. The entire ground installation system merely includes a base plate and a few ground stakes, and it is fairly easy to assemble and disassemble the installation system without special training and skills. Also, the ground installation system provides a stable and secure base for the fixtures thereon.

8 Claims, 12 Drawing Sheets

METHOD AND APPARATUS FOR GROUND INSTALLATION

FIELD OF THE INVENTION

The present invention relates to a method and apparatus for installing fixtures, and more particularly to a method and apparatus that provides a stable, secure and easy way to install and uninstall fixtures on the ground.

BACKGROUND OF THE INVENTION

Landscaping becomes more and more popular in recent years because people have a much higher demand on quality of the living environment. A series of outdoor lights are usually installed to illuminate buildings, gardens, pathways, and entranceways for safety purposes by reducing and eliminating dark hiding places and unobserved entry points for intruders. Moreover, the outdoor lights can be arranged to decorate the gardens, patios or yards to enhance the aesthetic value thereof. However, one problem of many conventional outdoor light fixtures is that once the lighting fixture is installed, it is very difficult and inconvenient to uninstall and the process to uninstall is usually costly and labor-intensive. It poses a serious problem if the homeowner likes to frequently change the location of the lighting fixtures for different designs.

U.S. Pat. No. 6,953,257 to Pusch discloses an outdoor light mounting system that provides a simple installation method for outdoor lighting fixtures. The outdoor light mounting system includes a foundation member in the form of a mildly compressible pipe member that is mounted in the ground, and an adapter that may form an electrical connection box, and a light standard can be mounted on the adapter. However, as can be seen in FIG. 1, Pusch's light mounting system still has too many components that have to be assembled/disassembled when the homeowner wants to install or uninstall the lighting fixture, which may cause the same problems as discussed above.

U.S. Pat. No. 7,073,919 to Masina discloses a light assembly including an elongate support having an upper end and an opposing lower end, and a light fixture. The elongated support incorporates an attached stake, which is to be forcibly inserted into the ground for supporting assembly in an upright condition as shown in FIG. 2. Even though the installation method proposed by Masina is less complicated than Pusch, the light assembly may not be stably secured on the ground with only one stake, especially when the light fixture is large and bulky. Furthermore, U.S. Pat. No. 6,802,630 to Doppelt discloses a portable outdoor lighting device. Even though a portable outdoor lighting fixture is easy to move without complicated installation process, it cannot be secured on the ground and may be easy to fall due to external forces, which may injure people or damage the lighting fixture.

Therefore, there remains a need for a new and improved method and apparatus to easily and securely install and uninstall fixtures on the ground to overcome the problems stated above.

SUMMARY OF THE INVENTION

It is an object of the present invention to provide a secure and easy method and system to install and uninstall fixtures on the ground, so that the homeowner can easily rearrange the fixtures in his/her garden or yard.

It is another object of the present invention to provide an inexpensive installation system for light fixtures on the ground to not only illuminate, but also decorate backyards, patios and gardens.

It is a further object of the present invention to provide a base plate with one or more receiving slots thereon to receive corresponding ground stakes, and the ground stakes can be hammered into the ground through the receiving slots to secure the base plate on the ground.

It is yet a further object of the present invention to provide one or more anchors on the base plate to engage with the fixture and to further secure the fixture on the ground.

In one aspect, a ground installation system includes a base plate and one or more ground stakes, and the base plate has one or more receiving slots corresponding to the ground stakes. Namely, the receiving slots are used for receiving the ground stakes. The base plate also has one or more through holes provided for anchors that can be used to secure a fixture on the base plate.

In one embodiment, the ground stake may include a body portion and a stopping piece, and the body portion may include two substantially similar sub-pieces to form an "L-shaped" body portion. One end of the body portion is covered by the stopping piece, and the other end is tapered and sharpened. The receiving slot used to receive the ground stake is a substantially "L-shaped" slot corresponding to the body portion, and the width of the receiving slot is slightly larger than the width of the body portion, so that the ground stake can be hammered into the ground through the receiving slot, and the ground stake can move all the way down until the stopping unit touches the base plate to stop the movement and secure the base plate on the ground. In other embodiments, the shape of the receiving slot can be changed, and the shape of the ground stake has to be changed accordingly to serve the same purposes as illustrated above. In some embodiments, the shape of the base plate can be changed as well.

In another aspect, a method to secure a fixture on a ground includes steps of securing one or more anchors on a base plate; placing the base plate on the ground; applying force to one or more ground stakes into the ground through the base plate to secure the base plate on the ground; disposing the fixture on the base plate; and securing the fixture on the base plate.

In one embodiment, the step of securing one or more anchors on a base plate may include a step of inserting the anchors from a back surface of the base plate. In another embodiment, the step of applying force to one or more ground stakes into the ground through the base plate to secure the base plate on the ground may include steps of providing one or more ground stakes that include a body portion having a flat end and a sharpened end, and a stopping unit attaching to the flat end of the body portion; providing one or more receiving slots on the base plate corresponding to the ground stakes; and inserting the ground stake through the sharpened end into the receiving slot to secure the base plate when the stopping end touches the base plate.

Comparing with the conventional arts, the present invention has following advantages: (i) the entire ground installation system merely includes a base plate and a few ground stakes, and it is fairly easy to assemble and disassemble the installation system without special training and skills; (ii) the manufacturing cost of the ground installation system is low; and (iii) the ground installation system in the present invention provides a stable and secure base for the fixtures thereon.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
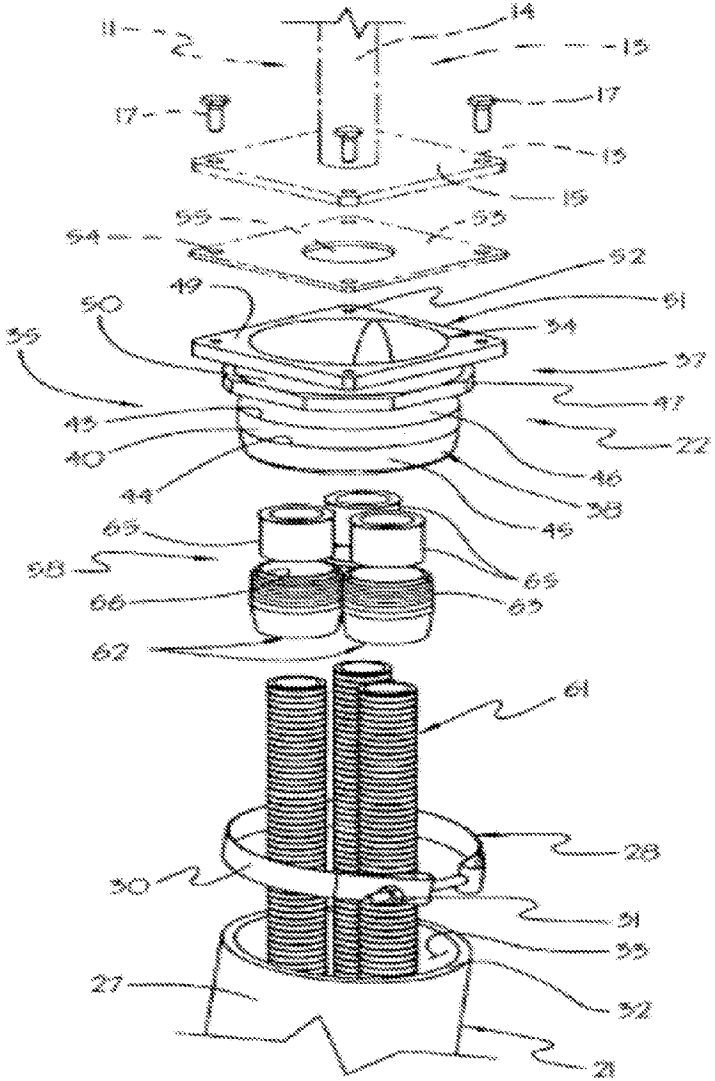
FIG. 1 (Prior art)
FIG. 1 is a prior art illustrating an outdoor light mounting system that provides a simple installation method for outdoor lighting fixtures.
Figure 2:
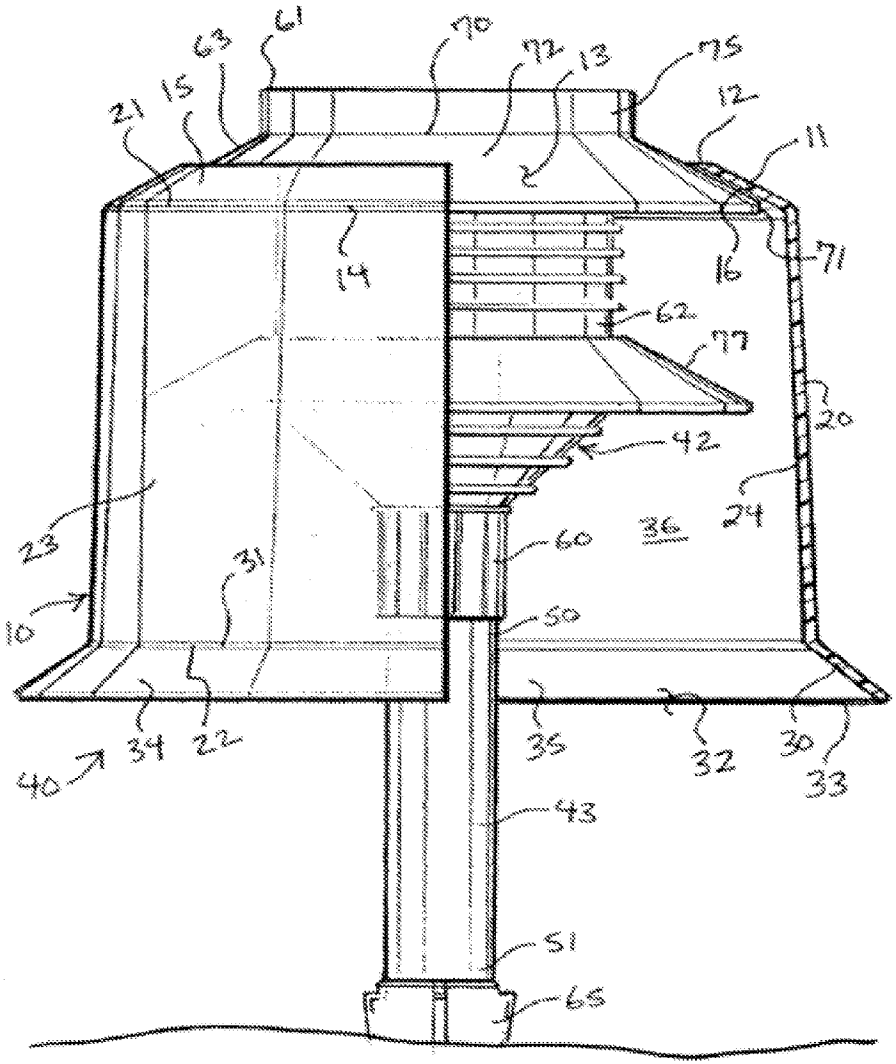
FIG. 2 (Prior art)
FIG. 2 is a prior art illustrating a light assembly including an elongate support having an upper end and an opposing lower end, and a light fixture.
Figure 3:
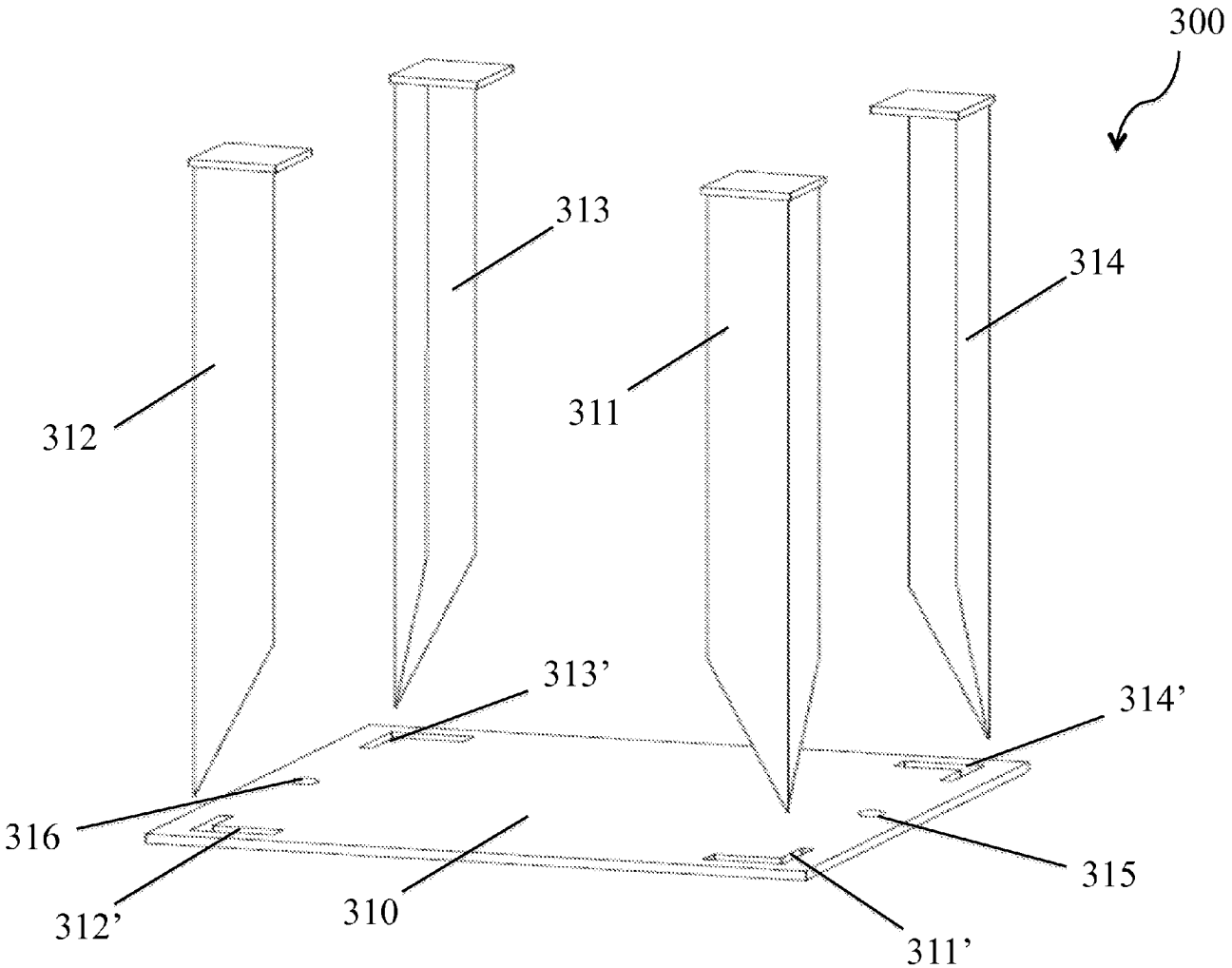
FIG. 3 illustrates a ground installation system in the present invention.

In order to further understand the goal, characteristics and effect of the present invention, a number of embodiments along with the drawings are illustrated as following:

Referring to FIG. 3, a ground installation system 300 includes a base plate 310 and one or more ground stakes 311, 312, 313 and 314. The base plate has more than one receiving slots 311', 312', 313' and 314', corresponding to the ground stakes 311 to 314. Namely, the receiving slots 311' to 314' are used to receive the ground stakes 311 to 314 and further secure the base plate 310. The base plate 310 also has one or more through holes 315 and 316 provided for anchors that can be used to secure a fixture on the base plate 310.

Figure 3A:
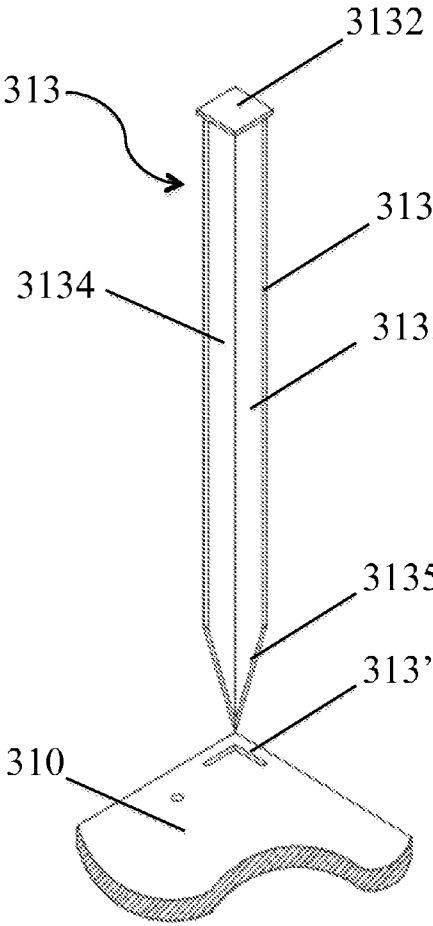
FIGS. 3*a* to 3*c* and 3*g* to 3*i* illustrate the mechanism of the ground stakes and corresponding receiving slots in the ground installation system in the present invention.
Figure 3B:
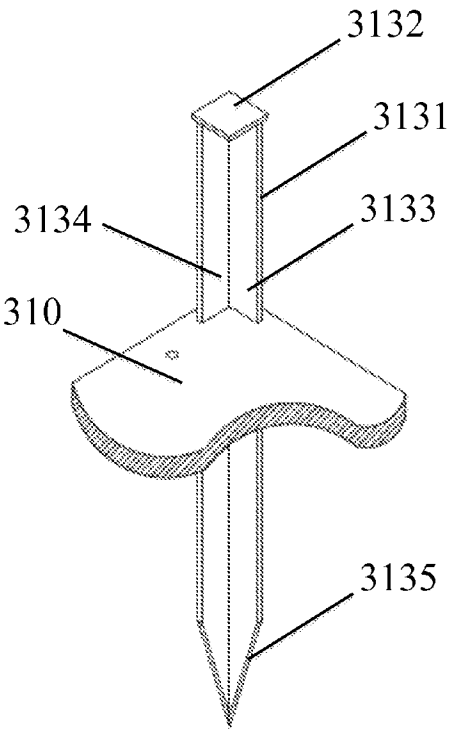
Figure 3C:
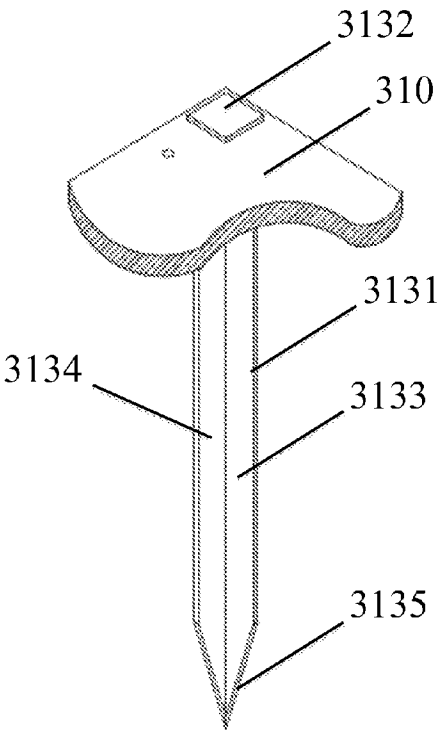

More particularly, the ground stake 313, for example, may include a body portion 3131 and a stopping piece 3132, as shown in FIG. 3*a*. The body portion 3131 may include two substantially similar sub-pieces 3133 and 3134 that are perpendicularly connected with each other. In other words, two sub-pieces 3133 and 3134 are configured to form an "L-shaped" body portion 3131. Moreover, a flat end of the body portion 3131 is covered by the stopping piece 3132, and the other end 3135 is tapered and sharpened. As can be seen in FIGS. 3*b* and 3*c*, the receiving slot 313' used to receive the ground stake 313 is a substantially "L-shaped" slot corresponding to the body portion 3131, and the width of the receiving slot 313' is slightly larger than the width of the body portion 3131, so that the ground stake 313 can be inserted into the receiving slot 313' through the sharpened end 3135, and the ground stake 313 can move all the way down until the stopping unit 3132 touches the base plate 310 to stop the movement of the ground stake 313. Meanwhile, the base plate 310 can be secured on the ground surface.

Figure 3F:
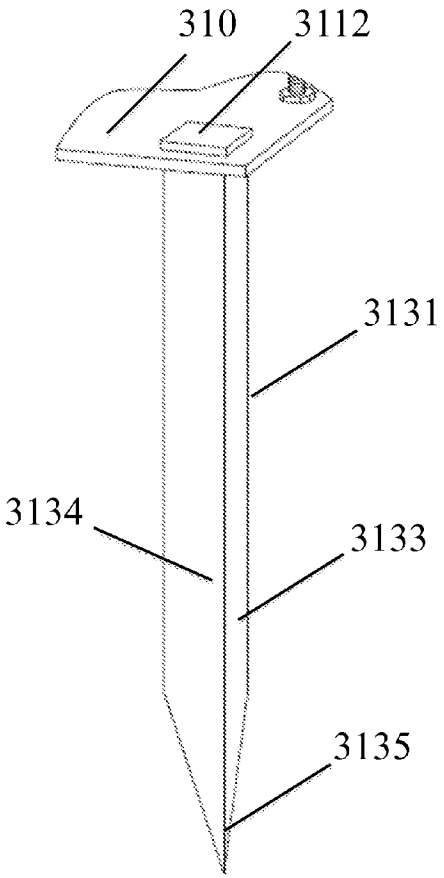
FIGS. 3*d* to 3*f* illustrate the mechanism of the ground stakes and corresponding receiving slots in the ground installation system in the present invention from a different view angle.
Figure 3E:
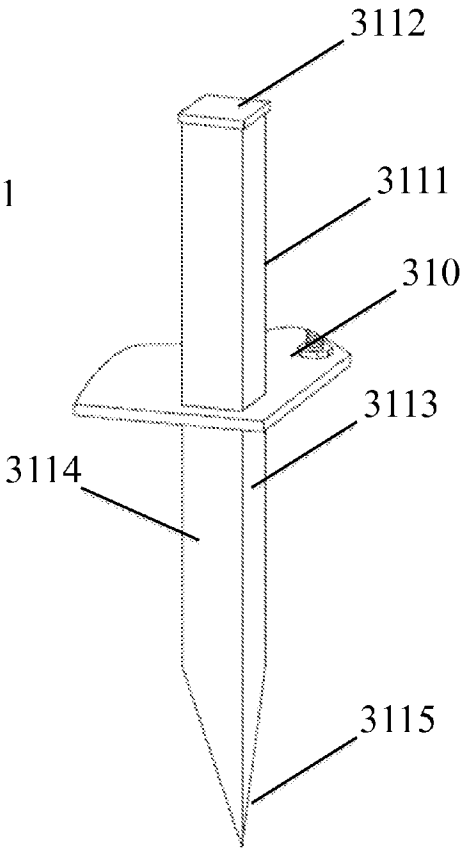
Figure 3D:
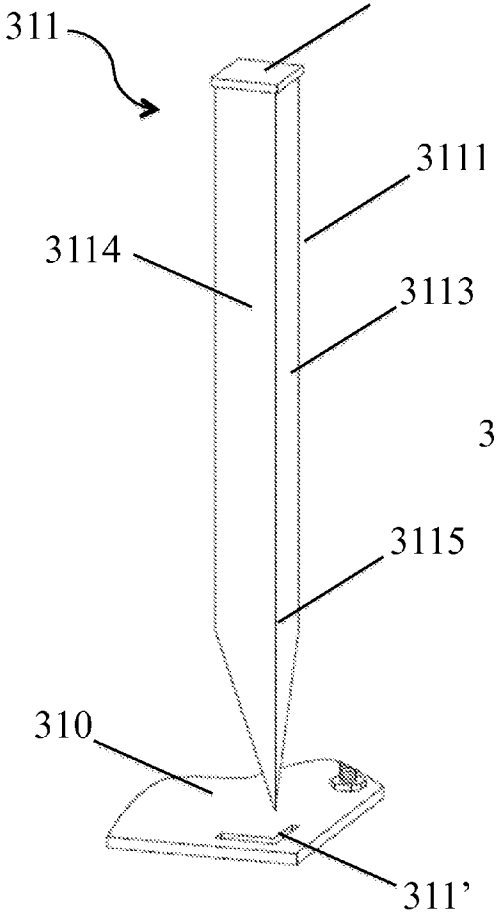
Figures 3G, 3H, 3I:
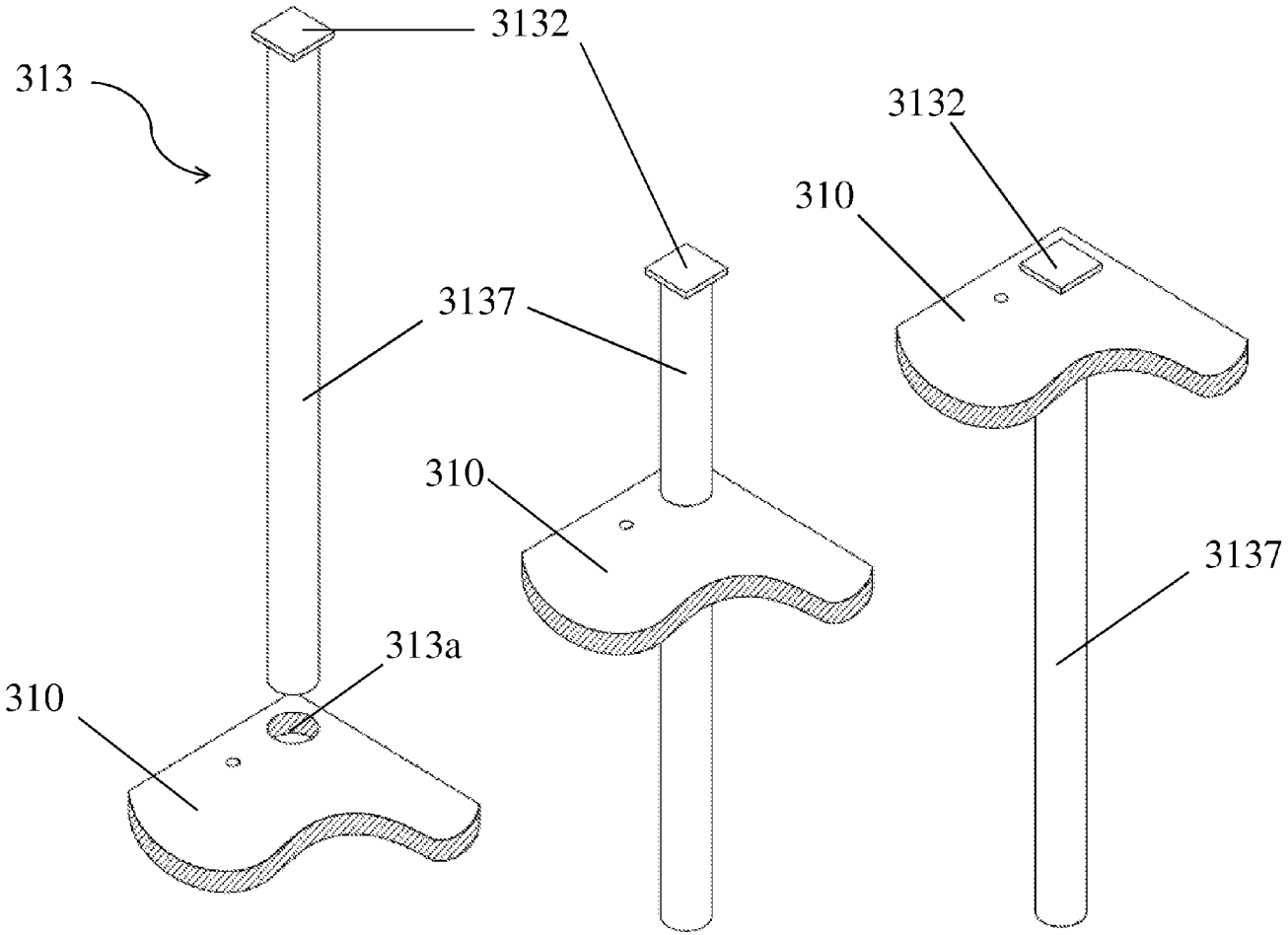

Referring to FIGS. 3*d* to 3*f*, another view angle of the ground installation system of the present invention is illustrated. Similarly, the ground stake 311 may include a body portion 3111 and a stopping piece 3112, and two substantially similar sub-pieces 3113 and 3114 form an "L-shaped" body portion 3111. The flat end of the body portion 3111 is covered by the stopping piece 3112, and the other end 3115 is tapered and sharpened. On the base plate 310, the receiving slot 311' that is used to receive the ground stake 311 is a substantially "L-shaped" slot corresponding to the body portion 3111, and the width of the receiving slot 311' is slightly larger than the width of the body portion 3111, so that the ground stake 311 can be inserted into the receiving slot 311' through the sharpened end 3115, and the ground stake 311 can move all the way down until the stopping unit 3112 touches the base plate 310 to stop the movement and the base plate 310 can be secured accordingly. In a further embodiment, as shown in FIGS. 3*g* to 3*i*, the body portion of the ground stake 313 can be cylindrical (3137), and the corresponding receiving slot (313*a*) can be circular that has a slightly larger periphery than the periphery of the cylindrical ground stake, so that the ground stake can be hammered into the ground through the receiving slot as previously illustrated.

Figure 4:
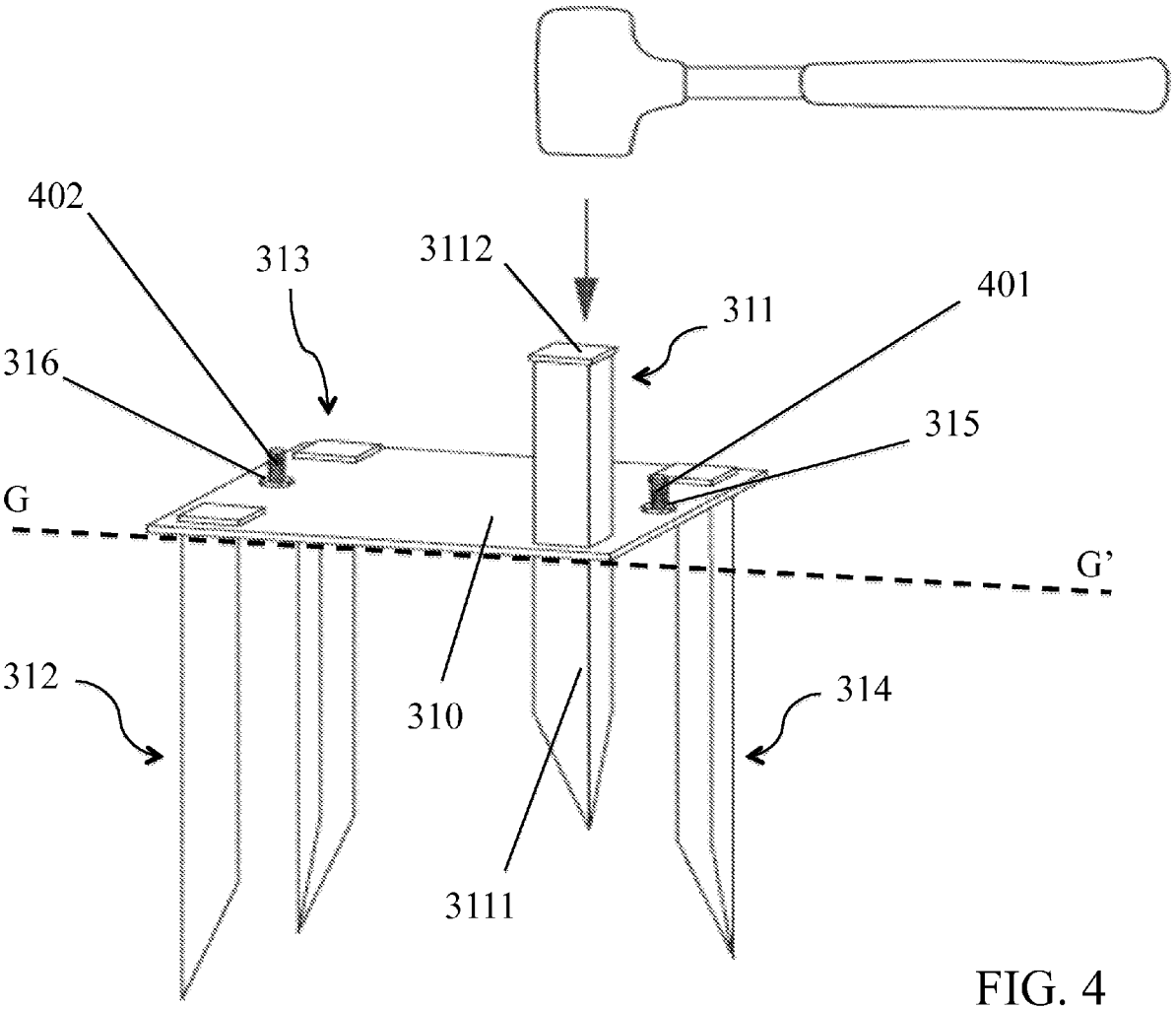
FIGS. 4 and 4*a* illustrate securing the base plate to the ground in the present invention.
Figure 4A:
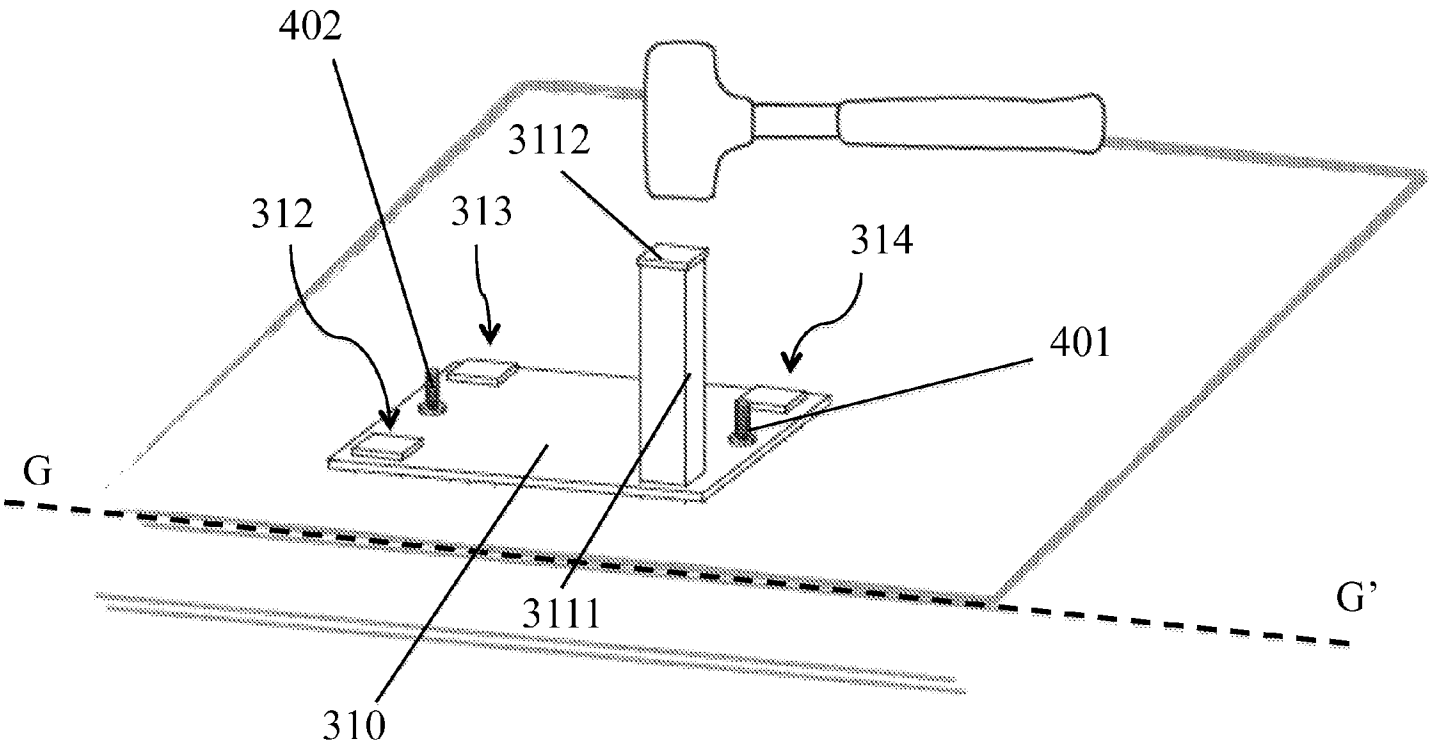

In one embodiment, as shown in FIGS. 4 and 4*a*, the base plate 310 is placed on a predetermined location on the ground, and the ground stakes 311 to 314 are hammered from the stopping units into the ground through corresponding receiving slots 311' to 314' (not shown) on the base plate 310. As previously described, the width of each receiving slot is slightly larger than the width of the body portion of the ground stake, so the ground stakes 311 to 314 can be hammered into the ground through corresponding receiving slots until the stopping units touch the base plate 310. At this time, the body portion of each ground stake is underneath a ground line G-G', while the stopping unit thereof is slightly above the ground line G-G', and the base plate 310 is securely positioned on the ground. It is noted that two anchors 401 and 402 are inserted through the through holes 315 and 316 respectively from a back surface of the base plate 310, and the anchors are provided to further secure a fixture on the base plate 310. It is also noted that the ground stakes and the base plate can be metal or other materials that can sustain external forces, such as hammer.

Figure 5:
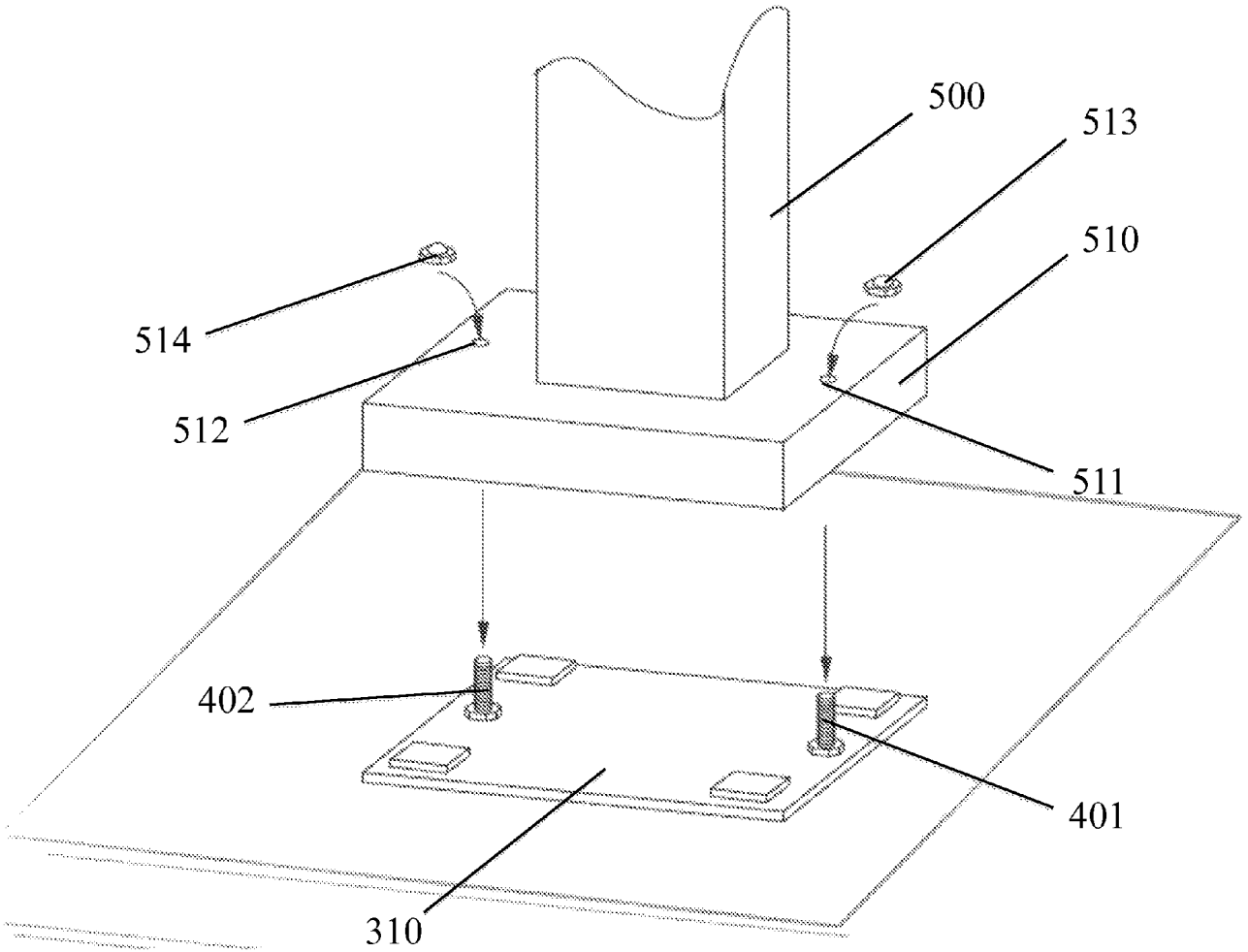
FIG. 5 illustrates the light fixture engaging with the base plate and being secured on the ground.

For example, as can be seen in FIG. 5, a light fixture 500 has a base 510 that has two through positioning holes 511 and 512. The size of the base 510 is substantially similar to the size of the base plate 310, and the positioning holes 511 and 512 are aligned with the anchors 401 and 402 on the base plate 310. When the light fixture 500 is disposed onto the base plate 310, the anchors 401 and 402 are aligned and inserted through the positioning holes 511 and 512 from a back surface of the base 510 to secure the light fixture 500. The length of the anchors has to exceed the thickness of the base 510, so that the anchors 401 and 402 can protrude from the back surface to a top surface of the base 510, and hex nuts 513 and 514 are provided to engage with the anchors 401 and 402 to further secure and tighten the light fixture 500 on the base plate 310.

Figure 6:
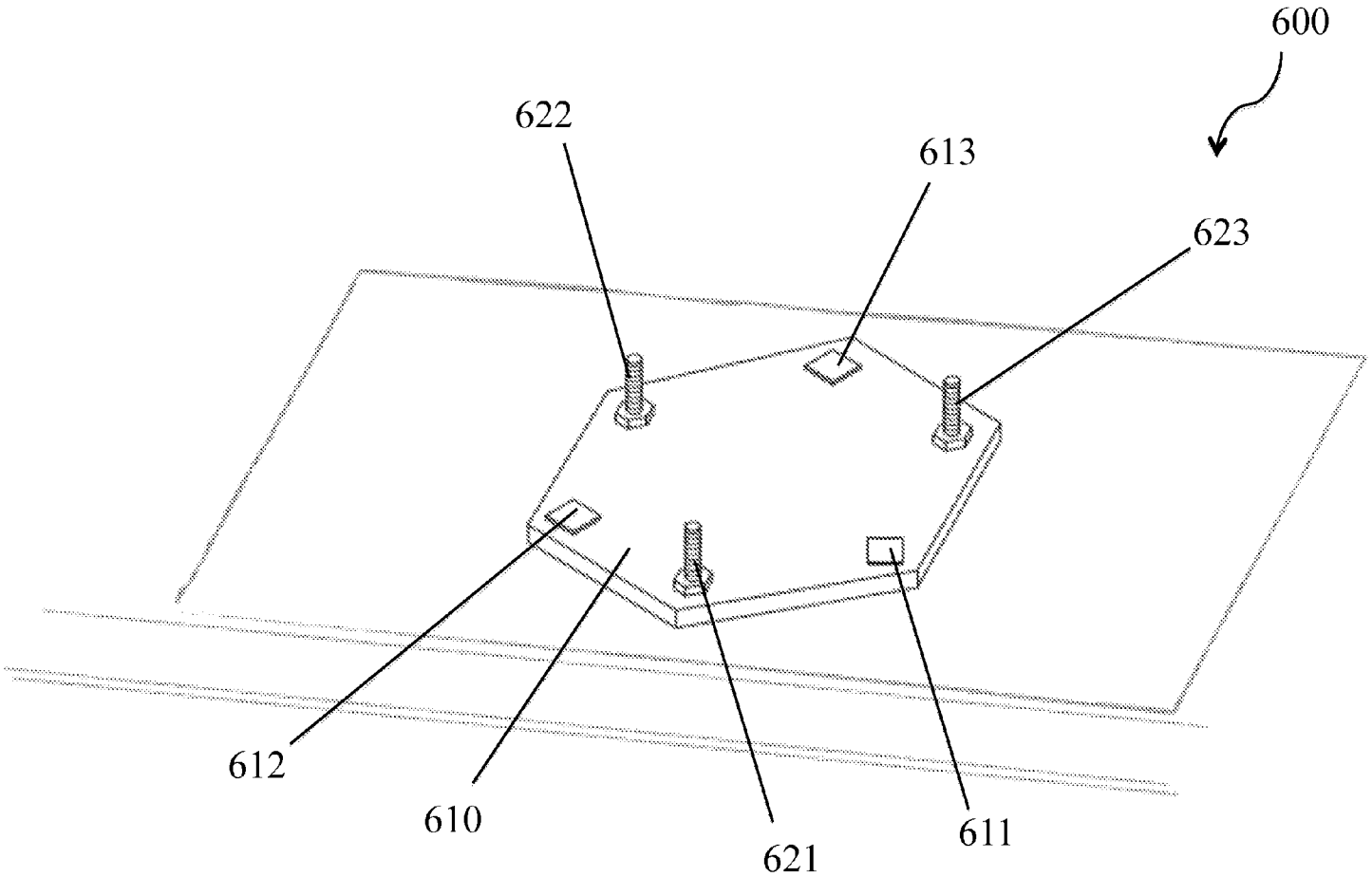
FIG. 6 illustrates another embodiment having a base plate with a different shape in the present invention.
Figure 7:
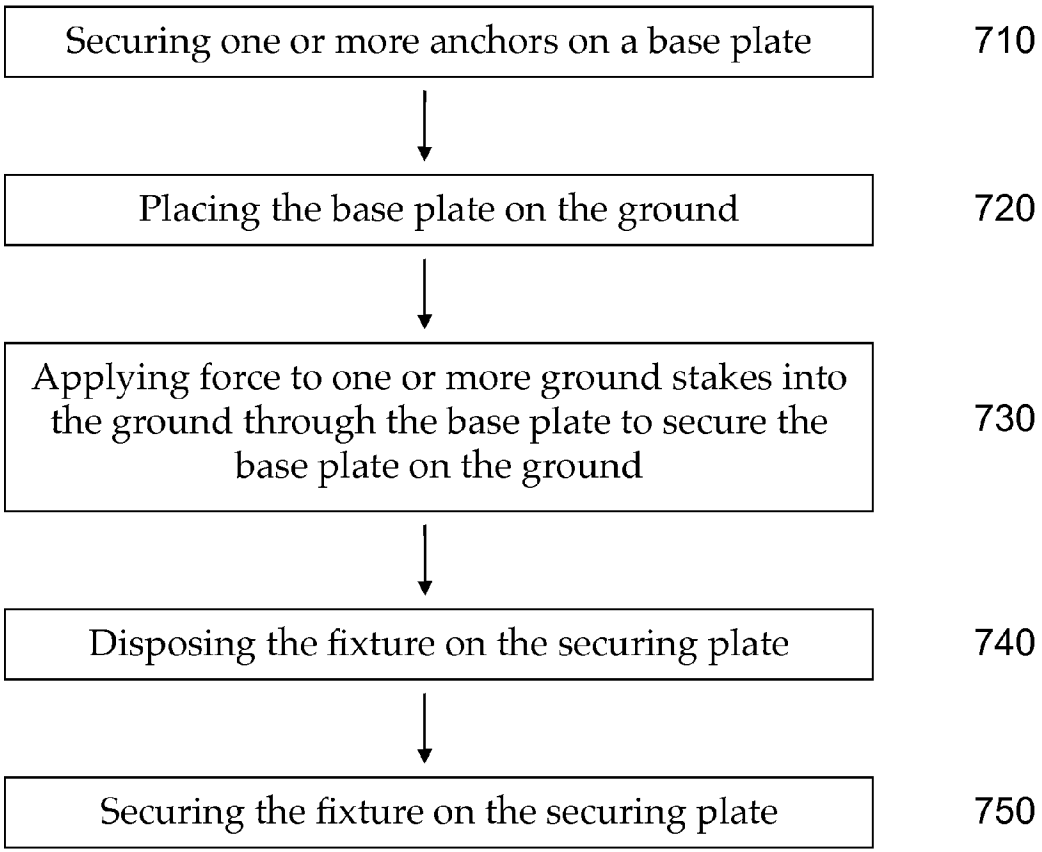
FIG. 7 illustrates a method of installing a fixture in the present invention.
Figure 7A:
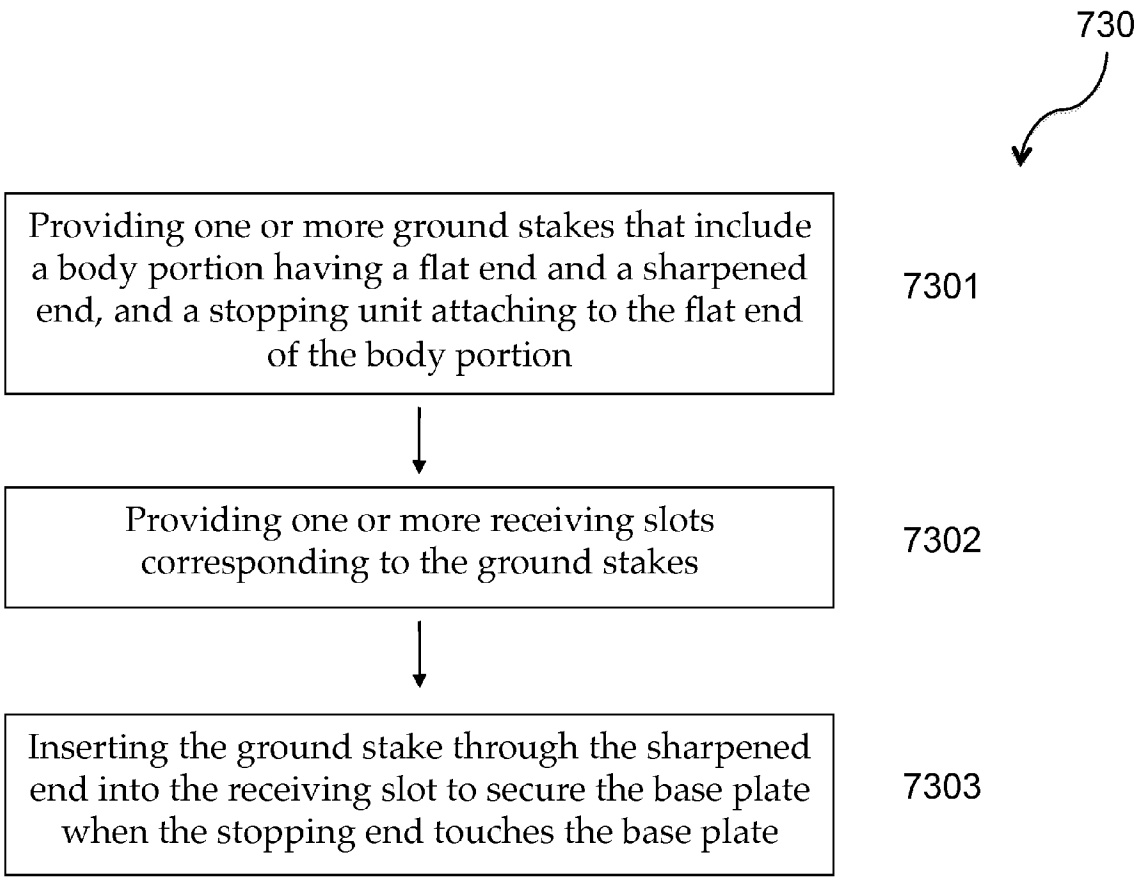
FIG. 7*a* illustrates one embodiment of the method of installing a fixture in the present invention.

In another embodiment, the base plate can be of another geometric shape. As can be seen in FIG. 6, a base plate 610 is hexagonal corresponding to a hexagonal base (not shown) of a light fixture. Likewise, the base plate 610 may have a one or more ground stakes (611, 612, 613) that are adepted to secure the base plate 610 on the ground surface as discussed above. The base plate 610 also has one or more anchors (621, 622, 623) that can protrude from a back surface to a top surface of the base of the fixture (not shown) to further secure the fixture on top of the base plate 610.

In another aspect, a method to secure a fixture on a ground includes steps of securing one or more anchors on a base plate 710; placing the base plate on the ground 720; applying force to one or more ground stakes into the ground through the base plate to secure the base plate on the ground 730; disposing the fixture on the base plate 740; and securing the fixture on the base plate 750.

In one embodiment, the step of securing one or more anchors on a base plate (710) includes a step of inserting the anchors from a back surface of the base plate 7101. In another embodiment, the step of applying force to one or more ground stakes into the ground through the base plate to secure the base plate on the ground (730) includes steps of providing one or more ground stakes that include a body portion having a flat end and a sharpened end, and a stopping unit attaching to the flat end of the body portion 7301; providing one or more receiving slots corresponding to the ground stakes 7302; and inserting the ground stake through the sharpened end into the receiving slot to secure the base plate when the stopping end touches the base plate 7303. In a further embodiment, the step of disposing the fixture on the base plate (740) may include a step of aligning positioning holes on the fixture with the anchors on the base plate 7401. In still a further embodiment, the step of securing the fixture on the base plate (750) may include a step of providing one or more hex nuts to engage with the anchors to secure the fixture on the base plate 7501.

According to the embodiments discussed above, the present invention has following advantages: (i) the entire ground installation system merely includes a base plate and a few ground stakes, and it is fairly easy to assemble and disassemble the installation system without special training and skills; (ii) the manufacturing cost of the ground installation system is low; and (iii) the ground installation system in the present invention provides a stable and secure base for the fixtures thereon.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A ground installation system comprising:

one or more anchors;

one or more ground stakes, said ground stake including a body portion and a stopping unit, said body portion having a flat end and a sharpened end, and said stopping unit attaching to the flat end; and a horizontal base plate having one or more receiving slots formed on the same level as said horizontal base plate to receive the ground stakes, wherein each ground stake is driven toward the direction of the ground through corresponding receiving slot on the horizontal base plate to secure the base plate on the ground.

2. The ground installation system of claim 1, wherein the ground stake is forced into the ground until the stopping unit touches the base plate.

3. The ground installation system of claim 1, wherein the body portion of the ground stake includes two sub-pieces arranged to form a substantially "L-shaped" body portion, and the corresponding receiving slot is substantially "L-shaped."

4. The ground installation of claim 3, wherein the width of the receiving slot is slightly larger than the width of the body portion, so that the ground stake is allowed to insert into the receiving slot through the sharpened end.

5. The ground installation system of claim 1, wherein the body portion of the ground stake is cylindrical, and the receiving slot is circular that has a slightly larger periphery than the periphery of the cylindrical ground stake, so that the ground stake is allowed to insert into the ground through the receiving slot.

6. The ground installation system of claim 1, wherein the anchors are aligned and inserted into positioning through holes of a base of a fixture to secure the fixture on the base plate on the ground.

7. The ground installation system of claim 6, wherein corresponding hex nuts are provided to engage with the anchors to further secure the fixture on the base plate.

8. The ground installation system of claim 7, wherein the fixture is a lighting fixture.

* * * * *